US006739408B2

(12) United States Patent
Rowden

(10) Patent No.: US 6,739,408 B2
(45) Date of Patent: May 25, 2004

(54) APPARATUS AND METHOD FOR PREPARING VARIABLE DENSITY DRILLING MUDS

(75) Inventor: Michael V. Rowden, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/015,161

(22) Filed: Oct. 26, 2001

(65) Prior Publication Data

US 2002/0108786 A1 Aug. 15, 2002

Related U.S. Application Data

(60) Provisional application No. 60/244,292, filed on Oct. 30, 2000.

(51) Int. Cl.[7] ..... E21B 21/08
(52) U.S. Cl. ..... 175/38; 175/206; 175/218
(58) Field of Search ..... 175/24, 38, 48, 175/206, 207, 218

(56) References Cited

U.S. PATENT DOCUMENTS

| | | | | |
|---|---|---|---|---|
| 3,085,587 A | | 4/1963 | O'Shields | 137/4 |
| 4,149,603 A | | 4/1979 | Arnold | 175/7 |
| 4,474,254 A | | 10/1984 | Etter et al. | 175/206 |
| 4,518,568 A | | 5/1985 | Shannon | 422/261 |
| 4,553,429 A | | 11/1985 | Evans et al. | 73/152.21 |
| 4,813,495 A | | 3/1989 | Leach | 175/6 |
| 5,303,998 A | | 4/1994 | Whitlatch et al. | 366/3 |
| 5,362,149 A | | 11/1994 | Nelson | 366/165.3 |
| 5,513,712 A | | 5/1996 | Sydansk | 175/69 |
| 5,775,852 A | | 7/1998 | Boutte et al. | 406/32 |
| 5,882,524 A | * | 3/1999 | Storey et al. | 175/66 |
| 6,035,952 A | | 3/2000 | Bradfield et al. | 175/66 |
| 6,102,673 A | | 8/2000 | Mott et al. | 417/392 |
| 6,119,772 A | * | 9/2000 | Pruet | 175/215 |
| 6,305,835 B1 | * | 10/2001 | Farrar et al. | 366/162.4 |
| 6,315,894 B1 | * | 11/2001 | Wiemers et al. | 175/206 |

* cited by examiner

*Primary Examiner*—David Bagnell
*Assistant Examiner*—Matthew J Smith
(74) *Attorney, Agent, or Firm*—Madan, Mossman & Sriram, P.C.

(57) ABSTRACT

Disclosed is an apparatus for preparing variable density drilling muds. The invention is particularly useful in offshore operations where storage and transportation of consumable materials is an important economic issue. One version of the apparatus is a portable apparatus requiring minimal deck space that can be used as needed and then removed. The invention is particularly useful during offshore dynamic kill drilling.

30 Claims, 6 Drawing Sheets

APPARATUS AND METHOD FOR PREPARING VARIABLE DENSITY DRILLING MUDS

PRIORITY

This invention claims priority of U.S. Provisional Patent Application Ser. No. 60/244,292 filed Oct. 30, 2000.

BACKGROUND OF THE INVENTION

1. Field of the Invention

The present invention relates to a method and apparatus for preparing variable density drilling muds and completion fluids. The present invention particularly relates to a method and apparatus for preparing variable density drilling muds for use on offshore drilling rigs.

2. Background of the Art

Drilling for oil and gas in very deep water presents problems not found in terrestrial or shallow water oil and gas exploration. One problem encountered in deep water is drilling fluid management. A drilling fluid is a fluid specially designed to be circulated through a wellbore as the wellbore is being drilled to facilitate the drilling operation. The circulation path of the drilling fluid typically extends from the drilling rig down through the drill pipe string to the bit face and back up through the annular space between the drill pipe string and wellbore face to the wellhead and/or riser, returning to the rig. The drilling fluid performs a number of functions as it circulates through the wellbore including cooling and lubricating the drill bit, removing drill cuttings from the wellbore, aiding in support of the drill pipe and drill bit, and providing a hydrostatic head to maintain the integrity of the wellbore walls and prevent well blowouts. The drilling fluid also desirably prevents sloughing and wellbore cave-ins when drilling through water sensitive formations.

There are a number of different types of conventional drilling fluids including compositions termed "drilling muds." Drilling muds comprise high-density dispersions of fine solids in an aqueous liquid, which is usually brine, or a hydrocarbon liquid. An exemplary drilling mud is a dispersion of clay and/or gypsum in water. The solid component of such a dispersion is termed a "weighting agent" and is designed to enhance the functional performance of the drilling fluid.

For the purposes of the present invention, a brine is an aqueous solution of sodium chloride or calcium chloride. Preferable, the brine is near saturation, but the term brines also include more dilute solutions, including but not limited to seawater.

In shallow water drilling, a riser system, that is a separate casing rising from the sea floor to the base of a drilling ship or drilling rig, can be used to return drilling mud to a drilling ship or platform for reuse. The use of a riser is not without problems, and these problems can be exaggerated in deep water drilling projects. One such problem is weight. A 6,000-foot riser 21 inches in diameter holding drilling mud has been estimated to weigh from about 1,000 to 1,500 tons. It is for this reason that riserless drilling methods have beer disclosed, particularly for deep water drilling, in patents such as U.S. Pat. No. 6,102,673 to Mott, et al., and U.S. Pat. No. 4,149,603 to Arnold.

Another problem encountered in offshore drilling is space. On either a drilling ship or a drilling platform, the tools essential to drilling a well require a lot of space. For example, to drill a well requires a drilling apparatus that includes motors and hoists and the like. Also needed for drilling a well are pumps, pipe, drilling fluids, casings, fuel, and living space for a crew. As with any construction project involving a ship or drilling platform, it generally costs more to build larger. It is for this reason that drilling ships and platforms are built no larger than necessary and any new process for such a venue is desirably not space intensive. It is also desirable in the art of drilling oil and gas wells using drilling ships and platforms to improve existing processes to require less space.

Yet another problem with offshore drilling is logistics. Since there are no roads or rail service to offshore installations, pipe, drilling mud, drill bits, personnel, fuel, and the like must all be delivered by means of boats or helicopters. While there is a service industry that provides such services, the modes of transportation are more expensive than truck or rail transportation and more difficult schedule. Therefore, it would be desirable in the art of drilling offshore oil wells to reduce volume of consumable supplies needed to drill an oil well.

SUMMARY OF THE INVENTION

In one aspect, the present invention is an apparatus for preparing variable density drilling muds comprising a mixing chamber, a first and a second feed line serving the mixing chamber, the first feed line having a first flow meter and a first control valve therein, and the second feed line having a second flow meter and a second control valve therein, wherein at least one of the flow meters is responsive to a nonintrusive sensory mechanism.

In another aspect, the present invention is a method of preparing variable density drilling muds comprising feeding water and a high-density base fluid to an apparatus for preparing variable density drilling muds, the apparatus comprising a mixing chamber, a first and a second feed line serving the mixing chamber, the first feed line having a first flow meter and a first control valve therein, and the second feed line having a second flow meter and a second control valve therein, wherein at least one of the flow meters is responsive to a nonintrusive sensory mechanism.

In still another aspect, the present invention is a portable apparatus for preparing variable density drilling mud comprising an apparatus for preparing variable density drilling muds, the apparatus comprising a mixing chamber, a first and a second feed line serving the mixing chamber, the first feed line having a first flow meter and a first control valve therein, and the second feed line having a second flow meter and a second control valve therein, wherein at least one of the flow meters is responsive to a nonintrusive sensory mechanism, wherein the mixing chamber and other elements are sized to fit into a rectangular form having dimensions of about 4 feet by 4 feet by 2 feet and further comprising a frame to hold apparatus elements, a means for attaching the frame to the deck of a ship or drilling rig, and quick couplings for attaching the feed lines to hoses having compatible couplings.

BRIEF DESCRIPTION OF THE DRAWINGS

For a detailed understanding of the present invention, reference should be made to the following detailed description of the preferred embodiments, taken in conjunction with the accompanying drawings, in which like elements have been given like numerals, wherein.

Figure 1A:
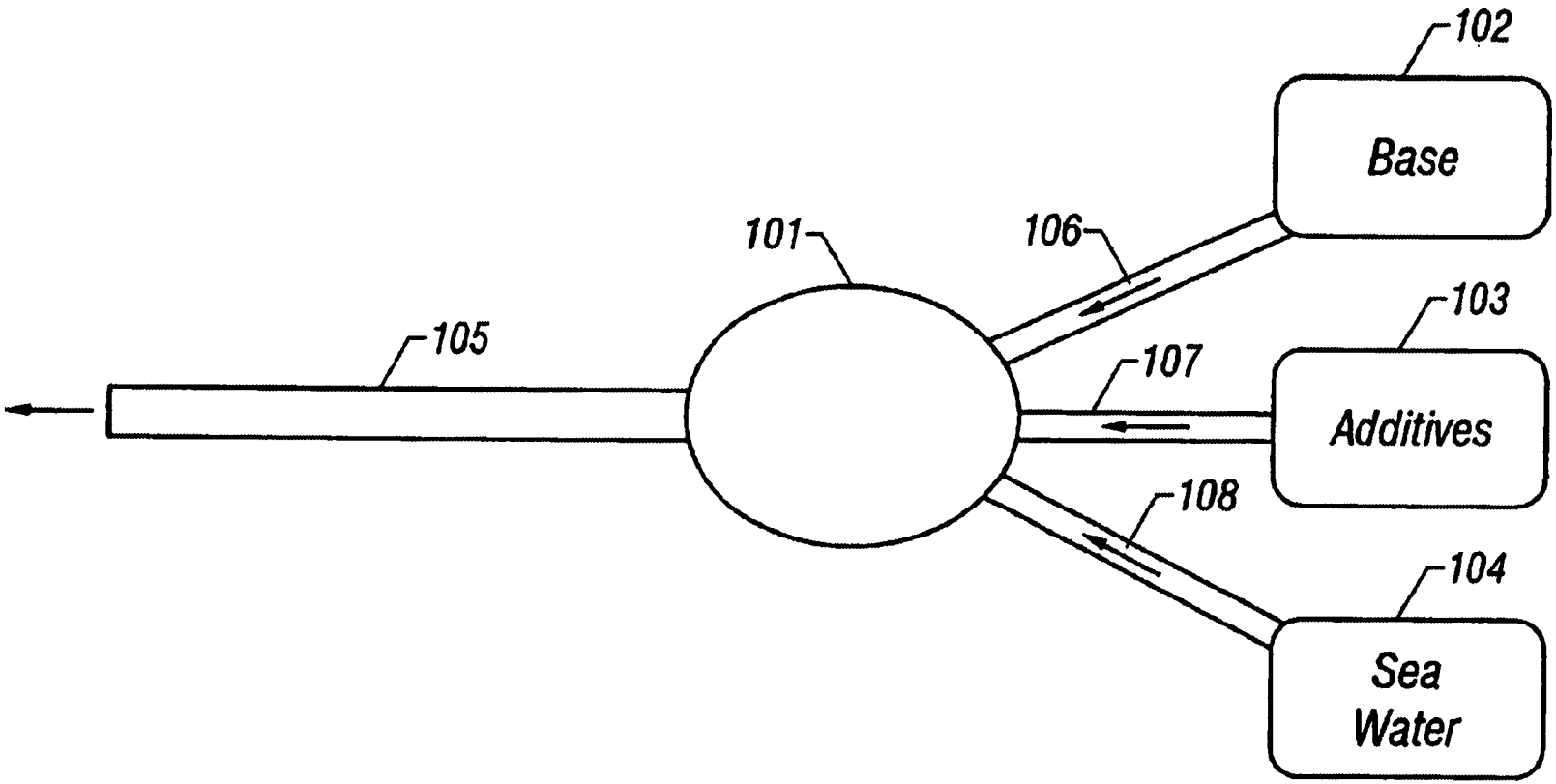
FIG. 1A is a schematic illustration of the basic apparatus of the present invention.

It will be appreciated that the figures are not necessarily to scale and the proportions of certain features are exaggerated to show detail.

DESCRIPTION OF THE PREFERRED EMBODIMENTS

One embodiment of the present invention is an apparatus for preparing variable density drilling muds. For purposes of the present invention, a drilling mud is any drilling fluid, including completion fluids, which can be prepared using a high-density base fluid and water. Exemplary of such fluids is the clay and gypsum dispersions disclosed hereinabove.

The muds prepared using the apparatus of the present invention can be prepared with varying densities. One advantage of the present invention is the ability to take a high density base fluid and admix it with varying amounts of water to produce muds having a density intermediate between the density of the water and the base fluid. This ability provides a logistical advantage to those who drill oil wells where space for having multiple mud pits is not available, for example those who drill wells from floating vessels i.e., ships, semi-submersibles, and the like, and offshore platforms. Having one pit filled with mud having a high density both saves space and reduces transportation costs. Shipping muds at lower densities means, in effect, shipping water, and water in the form of seawater is a commodity commonly available to both floating drilling vessels and offshore drilling platforms.

The need for multiple density muds is evident in drilling processes. For example, when starting an offshore well, it is common to drill the first part of the well using seawater alone. As the well progresses, the pressures of any flow from the well, be it water, gas or oil, and the lateral pressures on the sides of the holes increase. As already stated, during the first phase of drilling the well, the pressures are minimal which allows for the use of seawater, which has a typical density of approximately 8.55 pounds per gallon, as a drilling fluid. As the well progresses, the density of the fluid used is increased such that the weight of the mud column creates a hydrostatic pressure sufficient to prevent the escape of high-pressure material likely to be encountered. The process of varying the density of muds used while drilling is sometimes referred to in the art as Dynamic Kill Drilling or DKD.

In one preferred embodiment, the present invention is an apparatus for preparing variable density drilling muds comprising a mixing chamber, first and second feed line serving the mixing chamber, the first feed line having a first flow meter and first control valve therein, and the second feed line having a second flow meter and second control valve therein, wherein at least one of the flow meters is responsive to a nonintrusive sensory mechanism. For purposes of the present invention, a flow meter is a device for measuring the flow of a material in a feed line of the apparatus of the present invention and includes the sensory mechanism; transmitter, for sending a signal from the sensory mechanism, if any; interpretive mechanism, for converting the signal into a flow measurement, if any; local display or read out, if any; and any other mechanism needed to perform the function of measuring the rate of flow of a fluid in the feed line and providing an output of same.

The flow meters useful with the present invention are flow meters that have a sensory mechanism that is nonintrusive. In the practice of the present invention, a feed stream of base fluid is fed through a feed line into the mixing chamber of the apparatus of the present invention. In actual practice, any feed stream, but particularly the base fluid feed stream may contain agglomerations and debris that can render inaccurate or even inoperative conventional flow meters having rotors or turbines in the path of flow as sensory mechanism. Any flow meter that uses a nonintrusive sensory mechanism for measuring flow can be used. For example, the so-called "mag-flow" flow meters that measure flow by the effect of a fluid passing through magnetic flux lines can be used with the present invention. Preferably, the flow meters useful with the present invention include mag-flow meters, ultrasonic flow meters, and the like.

The apparatus of the present invention includes a mixing chamber serviced by a feed line, the feed line having a flow meter and a control valve therein. Preferably the control valve is located between the flow meter and the mixing chamber. Advantageously, when used to prepare drilling mud, the apparatus of the present invention has improved precision in regard to preparing muds with a specific density because this control valve and flow meter configuration. Control valves can create turbulence and back pressure that can distort flow readings in sensors near in proximity of the valves, particularly when the valve is upstream of the flow meter. For purposes of the present invention, the terms upstream and downstream mean for two points on a pipe or other device through which a fluid is passing, fluid entering the pipe first passes the upstream point prior to passing the down stream point. This turbulence and backpressure can be worse during the periods of valve actuation but are often present even when the valve is not being actuated. In an apparatus of the present invention, the control valve being downstream from the flow meter reduces interference with the operation of the flow meter caused by the control valve which results in more accurate flow readings.

The apparatus for preparing variable density drilling muds of the present invention can be composed of any materials known to one of ordinary skill in the art preparing drillings muds to be useful for preparing such devices. The apparatus of the present invention is preferably prepared using metals such as steel, cast iron, aluminum, and the like. Where weight is critical, certain polymers and polymer composites can also be used in construction of the present invention provided that due care is exercised to ensure that all the parts thereof are of a robust design capable of withstanding the corrosive effects of drilling mud and its constituents and the operating pressures employed during drilling or completion fluid production.

While there is no official standard for piping sizes on board drilling vessels and platforms for drilling mud preparation, a common size of piping is 4 inches. Preferably the feed lines servicing the mixing chamber of the apparatus of the present invention are 4-inch lines, but any size lines can be used. The feed lines can be adapted out to 6 inches for at least 30 inches on either side of the flow meter for applications where very high throughputs are required. Preferably, the feed line and the flow meter have the same diameter and the feed is substantially straight for at least 30 inches on both sides of the flow meter.

The apparatus of the present invention has a first and second feed line servicing the mixing chamber. When used to prepare drilling muds, one of these feed lines is connected to a pressurized source of water and the other feed line is connected to a pressurized source of base drilling fluid. In a preferred embodiment, the apparatus of the present invention includes a third feed line, this feed line preferably also having a flow meter and a control valve. In the production of drilling fluids, the third line can be used to incorporate additives such as brine, viscosifiers, defoamers, fluid loss agents, and other chemicals and mixtures thereof into the drilling mud.

The apparatus of the present invention can also be prepared with a fourth feed line. In this embodiment, the first three lines are feed lines servicing the mixing chamber. Using this configuration, base fluid, brine and calcium chloride can be fed separately to the mixing chamber. In this configuration, the fourth line can be used to incorporate additives.

The apparatus of the present invention includes a mixing chamber, preferably having a mixing device. The mixing chamber of the present invention can be as simple as a mere manifold or it can be a vessel or combination of a manifold and a vessel. During the practice of the method of the present invention, the purpose of the mixing chamber is to accept the flow of fluids from the feed lines and cause the dispersion of the fluids into each other. In one embodiment, the mixing chamber includes a static mixer in the fluid path leading to the exit of the mixing chamber. In another embodiment, the mixing chamber includes at least one baffle in the fluid path leading to the exit of the mixing chamber. In yet another embodiment, the mixing chamber includes both a static mixer and a baffle.

An exit line preferably services the mixing chamber of an apparatus of the present invention. While the exit line can be of any size preferably it is a 4-inch line and even more preferably a 6-inch line. One advantage of a 6-inch exit line is that it is capable of handling the flow rates of even three 4-inch lines. In some applications, a large flow rate, such as 2,500 gallons per minute is preferable and this rate can easily be accommodated using a 6-inch exit line.

The apparatus for preparing variable density drilling muds of the present invention preferably includes at least one pressure detection device on at least one of the feed lines. In the practice of the method of the present invention, fluids are fed to the apparatus of the present invention. Preferably the fluids are pumped to the feed lines of the present invention.

Some drilling muds are corrosive, abrasive or both. As such, they can cause wear and tear on pump impellers. Stated another way, in an application of the method of the present invention, a pump having a feed source and connected to an apparatus of the present invention could be turned on and still not be effectively pumping a fluid to the apparatus. A flow meter such as those useful with the present invention is not always accurate at very high flow rates and very low flow rates. It is not unheard of that such a flow meter can output a random flow rate when in actuality there is no or very little flow through the meter. A pressure detection device can be used to verify that there is flow an apparatus of the present invention and as a signal of an operational problem.

In a preferred embodiment of the present invention, the apparatus of the present invention is controlled by an electronic control system. In such an embodiment, the flow meters are capable of sensing flow rates in the feed lines and outputting a signal to the controller that the controller can interpret as feed rate. Also in such an embodiment, the flow control valves are automatic and have an input interface which will allow an electronic controller to output a signal to the flow control valve which will actuate the valve to partially or fully open and close the valve.

The control valves of the present invention are preferably automatic which, for the purposes of the present invention, means that they are actuated by hydraulic, pneumatic or electronic servo means. Also preferably, the actuation means can be such that the valve can be either partially or fully operated. For example, in the practice of the method of the present invention, it is preferable that the control valves can be automatically opened and closed in increments of 5% or less.

In embodiments of the present invention that include an electronic control system, the electronic control system can be any such system known to be useful to one of ordinary skill in the art constructing apparatus such as the apparatus of the present invention. Preferably, the electronic control system is a computer having a microprocessor; resident memory that may include read only memories (ROM) for storing programs; tables and models; and random access memories (RAM) for storing data. The electronic control system preferably connects to the apparatus of the present invention by means of an electronic interface. The controller can be either remote or local. If the controller is remote, it can connect to the electronic interface by means of telephone lines, direct lines, and the Internet.

While an electronic controller useful with the present invention can be as simple as an interface panel wherein operator can dial in flow rates, preferably the interface is a computer and most preferably a so-called personal computer (PC). When a PC is used as the electronic controller for an apparatus of the present invention, it can be used to fully automate the process of preparing drilling muds. For example, in one embodiment of the method of the present invention, an operator enters the density of the feed materials and the desired density of the product drilling mud and the computer calculates and fully controls the processes of preparing the drilling mud.

In the method of the present invention, water and high-density base fluid is fed to an apparatus of the present invention to prepare a drilling mud. The high-density base fluid is preferably a concentrated aqueous dispersion of the weighting materials needed to prepare a selected drilling mud. For example, one preferred base fluid is 16 pounds per gallon drilling fluid wherein the weighting material is barite or hematite. In another embodiment of the method of the present invention, the weighting materials are calcium carbonate or salt. Any base fluid know to those of ordinary skill in the art to be useful in preparing drilling fluids can be used with the apparatus of the present invention.

In a particularly preferred embodiment of the present invention, an apparatus of the present invention is a portable apparatus for preparing variable density drilling mud wherein the mixing chamber and other elements are sized to fit into a rectangular form having dimensions of about 4 feet wide by 4 feet deep by 2 feet high. In this embodiment, the elements of the apparatus are attached to a frame to hold them in position both during transport and use. Also a part of this invention is a means for attaching the frame to the deck of a ship or drilling rig, and quick couplings for attaching the feed lines to hoses having compatible couplings. In one particularly preferred embodiment, the feed lines are not connected to the mixing chamber but are rather fitted on both ends with quick couple fittings as are the other points of attachment and the apparatus is shipped with hoses with compatible fittings wherein the largest single dimension is the length of the feed lines.

FIG. 1A is a schematic illustration of the basic apparatus of the present invention. A mixing chamber 101 is connected by three feed lines: 106, 107 and 108 respectively to a source for base fluid 102, additives 103, and sea water 104. An exit line 105 is similarly connected to the mixing chamber 101.

Figure 1B:
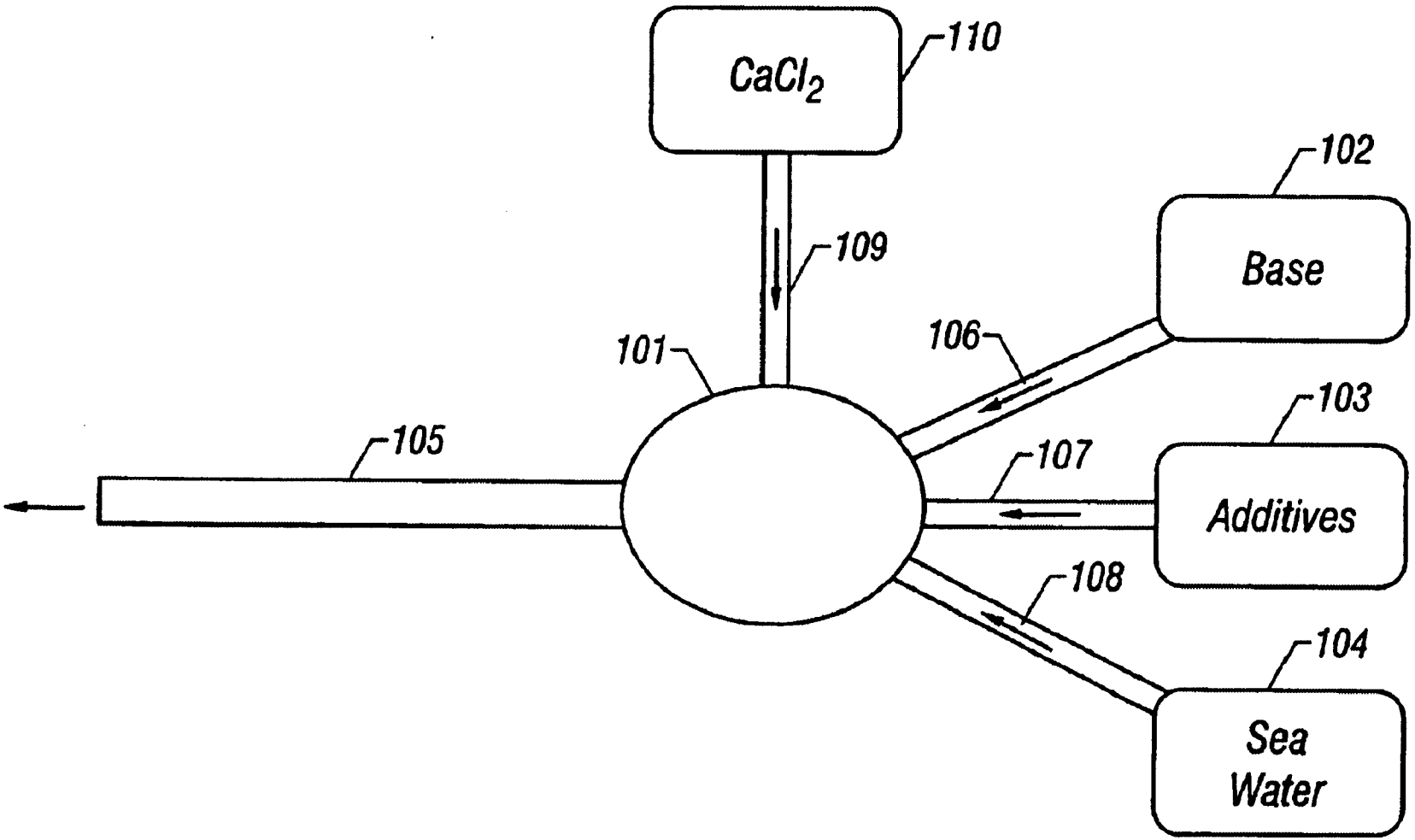
FIG. 1B is a schematic illustration of an alternative embodiment of the basic apparatus of the present invention.

FIG. 1B is a schematic illustration of an alternative embodiment of the basic apparatus of the present invention. In this figure, a fourth feed line 109 is used to supply a fourth component, $CaCl_2$, from a source thereof to the mixing chamber 101.

Figure 2:
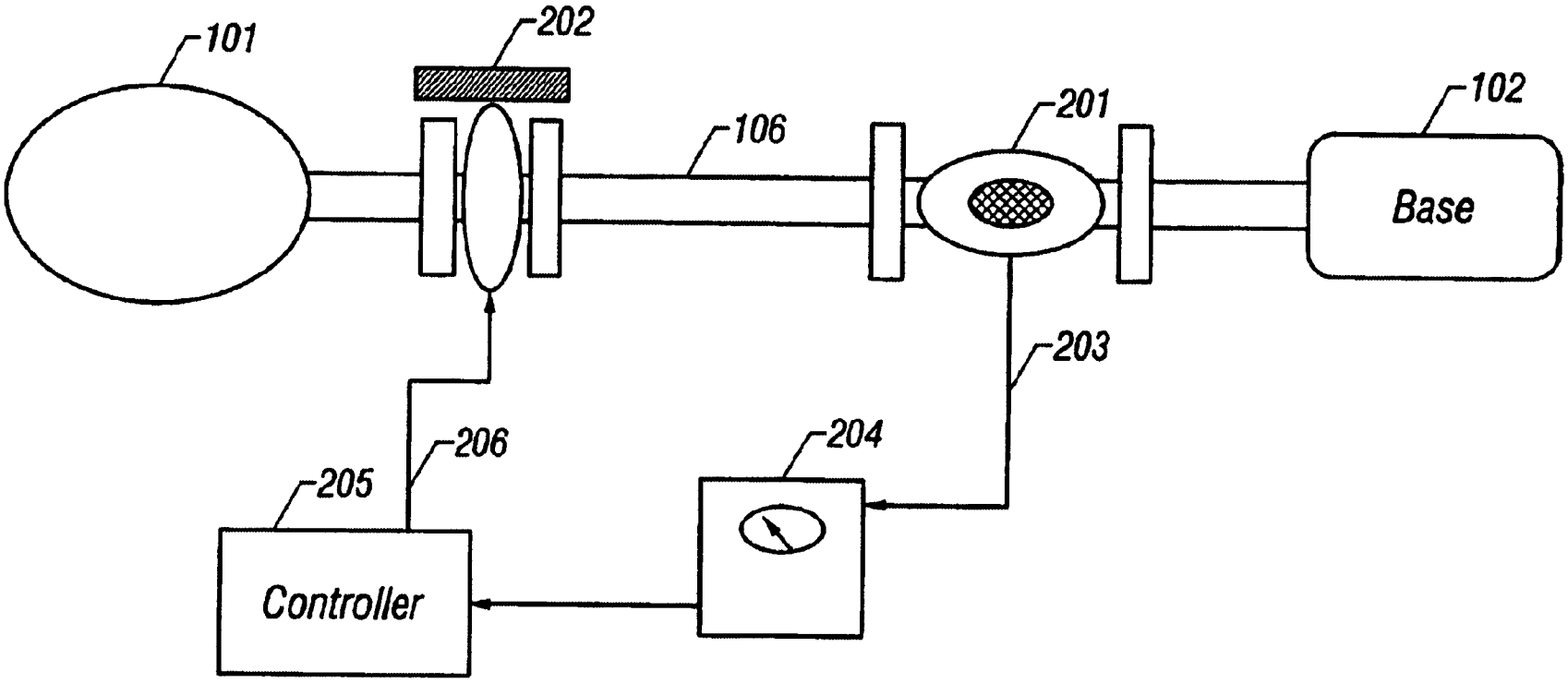
FIG. 2 is a schematic illustration of one section of the apparatus in FIG. 1 showing details from one feed line.

FIG. 2 is a schematic illustration of one section of the apparatus in FIG. 1 showing details from one feed line. In this embodiment, the feed line 106 includes a flow meter consisting of a sensory mechanism 201 and transmitter 204, and a control valve 202. Also shown are a controller 205 and the mixing chamber 101. The sensory mechanism 201 connected to the transmitter 204 by means of a wire or wireless connection 203. The transmitter 204 is connected to the controller 205 also by means of a wire or wireless connection. A separate wire or wireless connection 206 connects the controller and the control valve.

Figure 3:
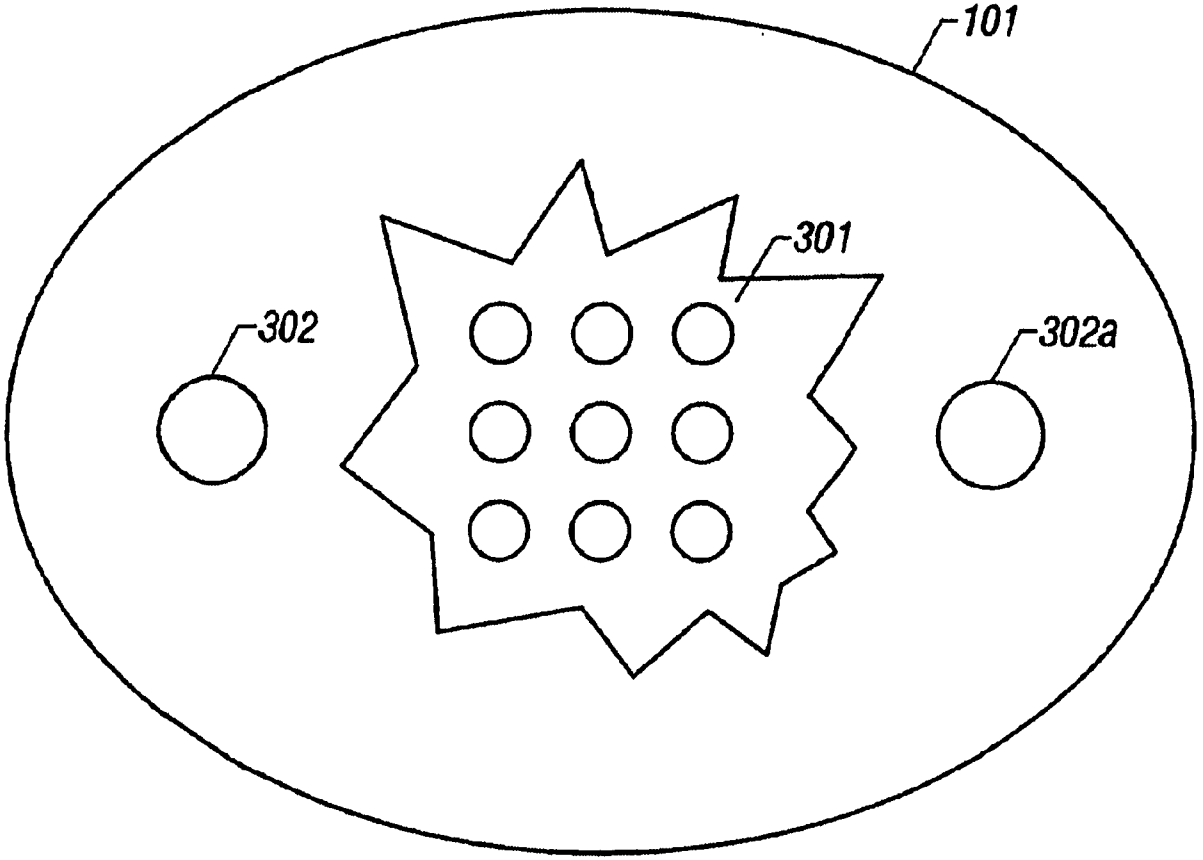
FIG. 3 is a cut-away illustration of a mixing chamber useful with the present invention.

FIG. 3 is a cut-away illustration of a mixing chamber 101 useful with the present invention. Shown are a first feed port 302 and a second feed port 302*a*. Within the cut-away section of the mixing chamber 101 is part of a static mixer 301. Not shown on the opposite side of the static mixer is an exit port which connects to an exit line.

Figure 4:
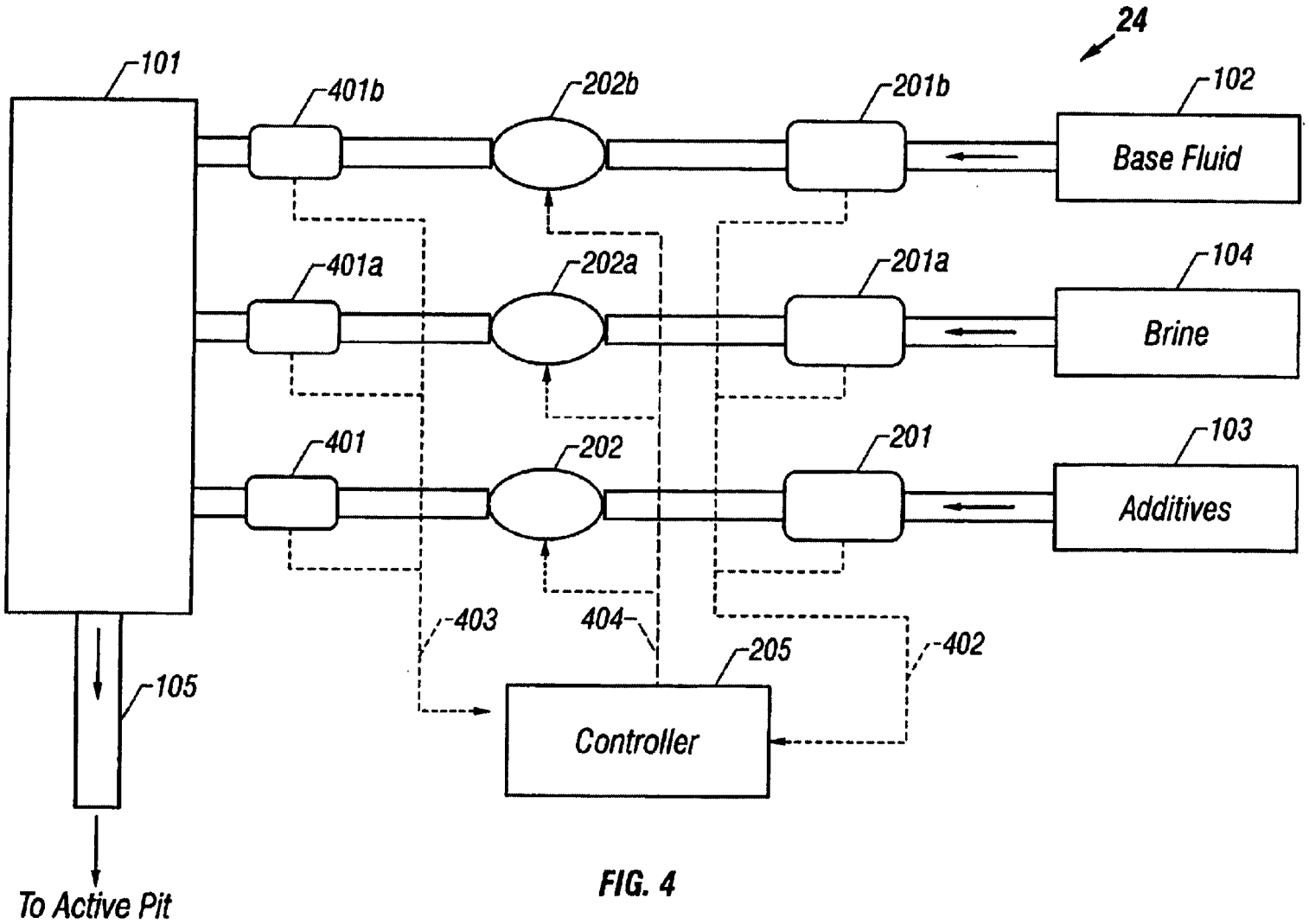
FIG. 4 is a schematic illustration of the method of the present invention.
Figure 5:
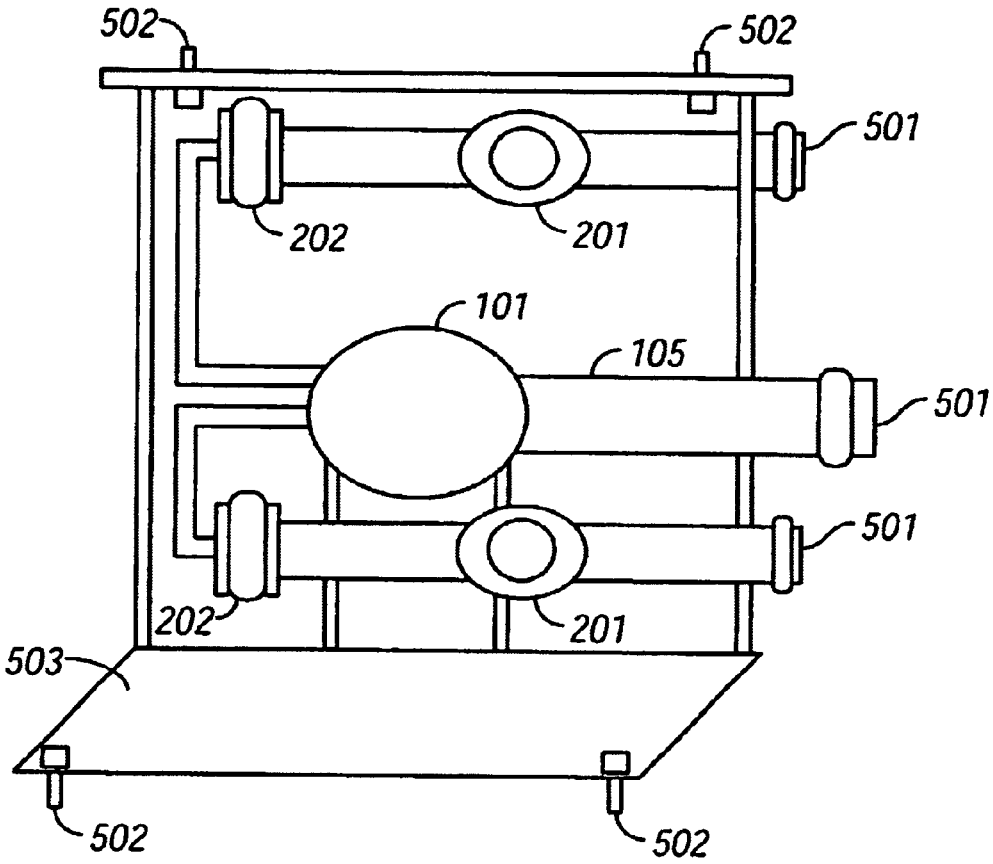
FIG. 5 is a schematic illustration of an alternative embodiment of the basic apparatus of the present invention.

FIG. 4 is a schematic illustration of the method of the present invention. As in the other figures, a mixing chamber 101 is connected by means of three feed lines to a base fluid source 102, a brine source 104, and an additive source 103. In each feed line is a flow meter (201, 201*a*, and 201*b*), a flow control valve (202, 202*a*, and 202*b*) and a pressure detection device (401, 401*a*, 401*b*). The pressure detection devices and the flow meters are connected by a wire or wireless circuit (403 and 402) to the controller 205. The controller is connected to the flow control valves (202, 202*a*, and 202*b*) by means of a wire or wireless circuit 404.

In the practice of the method of the present invention the base fluid 102, brine 104 and additives 103 and transported through the feed lines and into the mixing chamber 101 by means of pumps, pneumatic pressure, or any other available means of transporting the fluids (not shown) such that they arrive at the mixing chamber 101 with sufficient velocity to be dispersed one within the others. Within the mixing chamber 101, the combined fluid feeds pass through one or more static mixers, or one or more baffles or other mixing mechanism in the fluid flow path (not shown) and in the process are dispersed one within the others. The resultant drilling mud exits the mixing chamber by means of an exit line 105 and is sent to an active pit for use in drilling.

The controller 205 controls the production of drilling mud by means of the flow meters (201, 201*a*, and 201*b*), pressure detection devices (401, 401*a*, 401*b*), and control valves (202, 202*a*, and 202*b*). During mud production, the flow meters (201, 201*a*, and 201*b*) measure the flow of each feed stream. This data is sent to controller via a circuit 402. In one embodiment, an operator sets flow rates and the controller 205 compares the preset flow rate against the rate set by the operator.

In another embodiment, the operator enters a desired mud density and the density of the feed streams that are stored within the controller 205 in memory (not shown). Using a program, also in memory (not shown), the controller then calculates the necessary feed rate for each feed stream to produce the required mud density. Optionally, the operator can enter a desired rate of production that can also be used to calculate the feed rates for each feed stream. Once this solution is calculated, the controller then sends a signal to each control valve (202, 202*a*, and 202*b*) to actuate the valves to open or close as is required to produce the necessary feed rates for each stream.

During mud production, if the necessary feed rates for each stream cannot be maintained, the controller 205 can actuate an alarm (not shown) or shut down the system or take any other action required by the operator. Input from the pressure detection devices (401, 401*a*, 401*b*) can be used to monitor the system for problems.

In one embodiment, the present invention is a portable apparatus for preparing variable density drilling mud sized to fit into a rectangular form having dimensions of about 4 feet by 4 feet by 2 feet and having a frame to hold apparatus elements, and also having quick couplings for attaching the feed lines to hoses having compatible couplings. The drawing elements numbered in the 100's and 200's are as already defined above. 501 is a quick coupling hose connection. 502 is a means for connecting the apparatus to the deck of ship or a drilling rig. 503 is a frame to hold the apparatus elements.

Not shown in the figures are power supplies, pneumatic and hydraulic lines, and the like which are known to one of ordinary skill in the art of preparing apparatus such as the apparatus of the present invention to be useful in preparing such apparatus.

What is claimed is:

1. An apparatus for preparing variable density drilling muds comprising a mixing chamber, a first and second feed line serving the mixing chamber, the first feed line having a first flow meter and a first control valve therein, and the second feed line having a second flow meter and a second control valve therein, wherein at least one of the flow meters is responsive to a nonintrusive sensory mechanism; wherein the first and second feed lines are 4 inches in diameter; wherein the feed line having a flow meter responsive to a nonintrusive sensory mechanism has a section which is 6 inches in diameter; and wherein the 6-inch diameter feed line section includes the flow meter.

2. The apparatus of claim 1, wherein the flow meter responsive to a nonintrusive sensory mechanism is a magnetic flow meter.

3. The apparatus of claim 1, wherein on the feed line having a flow meter responsive to a nonintrusive sensory mechanism, the control valve is located between the flow meter and the mixing chamber.

4. The apparatus of claim 1, wherein the 6-inch diameter feed line section extends for at least 30 inches on both sides of the flow meter and is substantially straight.

5. The apparatus of claim 1, additionally comprising a third feed line, the third feed line serving the mixing chamber and having a flow meter and a control valve therein.

6. The apparatus of claim 1, wherein the mixing chamber includes a mixing device.

7. The apparatus of claim 6, wherein the mixing device is a static mixer.

8. The apparatus of claim 7, wherein the mixing device is a baffle.

9. The apparatus of claim 6, wherein the mixing device is a static mixer and baffle.

10. The apparatus of claim 1, additionally comprising an exit line serving the mixing chamber.

11. The apparatus of claim 10, wherein the exit line is 6 inches in diameter.

12. The apparatus of claim 1, wherein at least one feed line includes a pressure detection device.

13. The apparatus of claim 1, additionally comprising an electronic control system.

14. The apparatus of claim 13, wherein the flow meters have electronic outputs.

15. The apparatus of claim 14, wherein the control valves are automatic.

16. The apparatus of claim 15, wherein the control valves are actuated by a means selected from the group consisting of hydraulic actuation, pneumatic actuation, electronic servo actuation, and combinations thereof.

17. The apparatus of claim 15, wherein the electronic control system is configured to receive output from the flow meters.

18. The apparatus of claim 17, wherein the electronic control system is configured to control actuation of the control valves.

19. The apparatus of claim 18, additionally comprising an electronic interface.

20. The apparatus of claim 19, wherein the electronic interface is a remote controller.

21. The apparatus of claim 19, wherein the electronic interface is a local controller.

22. The apparatus of claim 21, wherein the local controller is an interface panel.

23. The apparatus of claim 21, wherein the local controller is a PC.

24. A method of preparing variable density drilling muds comprising feeding water and a high-density base fluid to the apparatus of claim 1.

25. The method of claim 24, wherein the water is brine.

26. The method of claim 25 additionally comprising changing the flow rates of the water and base fluid to produce of drilling muds of densities intermediate between the densities of the base fluid and the water.

27. The method of claim 26 additionally comprising monitoring the operation of the apparatus of claim 6 using an electronic control system.

28. The method of claim 27 additionally comprising changing the flow rates of the water and base fluid using the electronic control system.

29. A portable apparatus for preparing variable density drilling mud comprising an apparatus of claim 1, wherein the apparatus of claim 6 is sized to fit into a rectangular form having dimensions of about 4 feet by 4 feet by 2 feet and further comprising a frame to hold apparatus elements, and quick couplings for attaching the feed lines to hoses having compatible couplings.

30. The portable apparatus of claim 29 additionally comprising a means for attaching the frame to a deck of a ship or a drilling rig.

* * * * *